US005975967A

United States Patent [19]

Nishi

[11] Patent Number: 5,975,967

[45] Date of Patent: Nov. 2, 1999

[54] TILT DEVICE FOR MARINE PROPULSION DEVICE AND METHOD FOR ASSEMBLING THE TILT DEVICE

[75] Inventor: Manabu Nishi, Saitama, Japan

[73] Assignee: Showa Corporation, Saitama, Japan

[21] Appl. No.: 09/018,501

[22] Filed: Feb. 4, 1998

[30] Foreign Application Priority Data

Feb. 4, 1997 [JP] Japan ..... 9-34293

[51] Int. Cl.[6] ..... B63H 20/08

[52] U.S. Cl. ..... 440/61; 29/523

[58] Field of Search ..... 440/61; 29/523; 60/473, 475, 476

[56] References Cited

U.S. PATENT DOCUMENTS

| | | | |
|---|---|---|---|
| 2,352,390 | 6/1944 | Kirkland | 60/474 |
| 2,640,323 | 6/1953 | McLeod | 296/117 |
| 2,695,446 | 11/1954 | Meyer | 29/523 |
| 2,847,937 | 8/1958 | Garvey et al. | 60/473 |
| 3,473,325 | 10/1969 | Vargo | 60/476 |
| 5,129,137 | 7/1992 | Orihara et al. | 29/523 |
| 5,149,285 | 9/1992 | Kinoshita | 440/61 |

FOREIGN PATENT DOCUMENTS

| | | |
|---|---|---|
| 2296003 | 12/1990 | Japan . |
| 86715 | 2/1996 | Japan . |
| 5233286 | 3/1997 | Japan . |

*Primary Examiner*—Sherman Basinger
*Attorney, Agent, or Firm*—Dvorak & Orum

[57] ABSTRACT

The present invention provides a tilt device for a marine propulsion unit comprising a hydraulic cylinder device filled with a hydraulic fluid, where a piston fixed to one end portion of a piston rod is provided slidably in an inner cylinder and an outer cylinder, a tank device for storing the hydraulic fluid, and a pump device for the telescopic operation of the hydraulic cylinder device by supplying and exhausting the hydraulic fluid in the tank device into the hydraulic cylinder device, wherein a valve block of the pump device is cast-molded, the inner cylinder and the outer cylinder of the hydraulic cylinder device are made of a pipe material, a cylinder fixing portion having a diameter larger than that of the outer cylinder is formed in the valve block, and the outer cylinder is fixed to the cylinder fixing portion by the diameter enlarging processing.

17 Claims, 7 Drawing Sheets

TILT DEVICE FOR MARINE PROPULSION DEVICE AND METHOD FOR ASSEMBLING THE TILT DEVICE

BACKGROUND OF THE INVENTION

1. Field of the Invention

The present invention relates to a tilt device for a marine propulsion unit and a method for assembling the tilt device.

2. Description of the Prior Art

Examples of tilt devices for marine propulsion devices include a tilt device of an outboard motor. The outboard motor includes a propulsion unit comprising a propeller and an engine, supported axially by a swivel bracket such that the horizontal swinging movement is allowed, with the swivel bracket supported by a clamp bracket such that the vertical tilting movement is allowed, with the clamp bracket gripping the hull. A tilt device is provided between the clamp bracket and the swivel bracket such that the motive power is generated by the telescopic motion of a hydraulic cylinder of the tilt device. The propulsion unit and the swivel bracket are tilted vertically with respect to the clamp bracket so as to allow the tilt operation or the trim operation of the propulsion unit.

In addition to the above-mentioned hydraulic cylinder device, the tilt device further comprises a tank device for storing a hydraulic fluid and a pump device for supplying and exhausting the hydraulic fluid in the tank device into the hydraulic cylinder device so as to operate the hydraulic cylinder device telescopically.

As an example of a tilt device, Japanese Utility Model Application Publication (JP-Y) No. 8-6715 discloses a cylinder of a cylinder device, a valve block, which stores various kinds of valves of a pump device, and a tank case of a tank device integrally cast-molded.

However, the above-mentioned tilt device having the cylinder, the valve block, and the tank case formed as one piece requires a large casting mold and leads to the cost increase. Besides, since the cylinder is cast-molded, it becomes thick so that the tilt device becomes larger. Furthermore, since the cylinder is cast-molded, the production time is increased, such as the mirror processing of the inside of the cylinder, and a long boring processing for forming a channel in the molded cylinder.

SUMMARY OF THE INVENTION

In order to cope with the above-mentioned conventional problems, an object of the present invention is to provide a tilt device for a marine compulsion device, with easy and secure assembling, capable of achieving a reduction of production time, downsizing, and cost reduction, and a method for assembling the tilt device for a marine compulsion device with easy and secure assembling.

A tilt device for a marine propulsion device of the present invention comprises a cylinder device where a piston fixed at one end portion of a piston rod is provided slidably in a cylinder which is filled with a hydraulic fluid, a tank device capable of storing the hydraulic fluid, and a pump device for supplying and exhausting the hydraulic fluid in the tank device for operating the cylinder device telescopically so that the tilt operation of a propulsion unit is conducted by the telescopic motion of the cylinder device, wherein a valve block of the pump device is cast-molded, the cylinder of the cylinder device comprises a pipe material, a cylinder fixing portion having a diameter larger than the cylinder is formed in the valve block, and the cylinder is fixed at the cylinder fixing portion by a diameter enlarging processing.

An assembling method of the present invention of a tilt device for a marine propulsion device where a cylinder device comprises an inner cylinder and an outer cylinder, with a piston interlocked to a piston rod is slidably positioned in the inner cylinder with one end portion provided with a closing lid, and the other end portion of the inner cylinder and the outer cylinder provided with a rod guide, and one end portion of the inner cylinder and the outer cylinder fixed to a valve block of a pump device for assembling, comprising the steps of inserting the outer cylinder into the cylinder fixing portion of the valve block, diameter-enlarging-processing of one end portion of the outer cylinder for fixation to the cylinder fixing portion, accommodating the piston and the piston rod in the inner cylinder, inserting the inner cylinder assembly provided with the closing lid and the rod guide into the outer cylinder, and caulk-fixing of the other end portion of the outer cylinder to the rod guide of the inner cylinder assembly so as to assemble the cylinder device to the pump device.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

Hereinafter embodiments of the present invention will be described with reference to the accompanied drawings.

Figure 1:
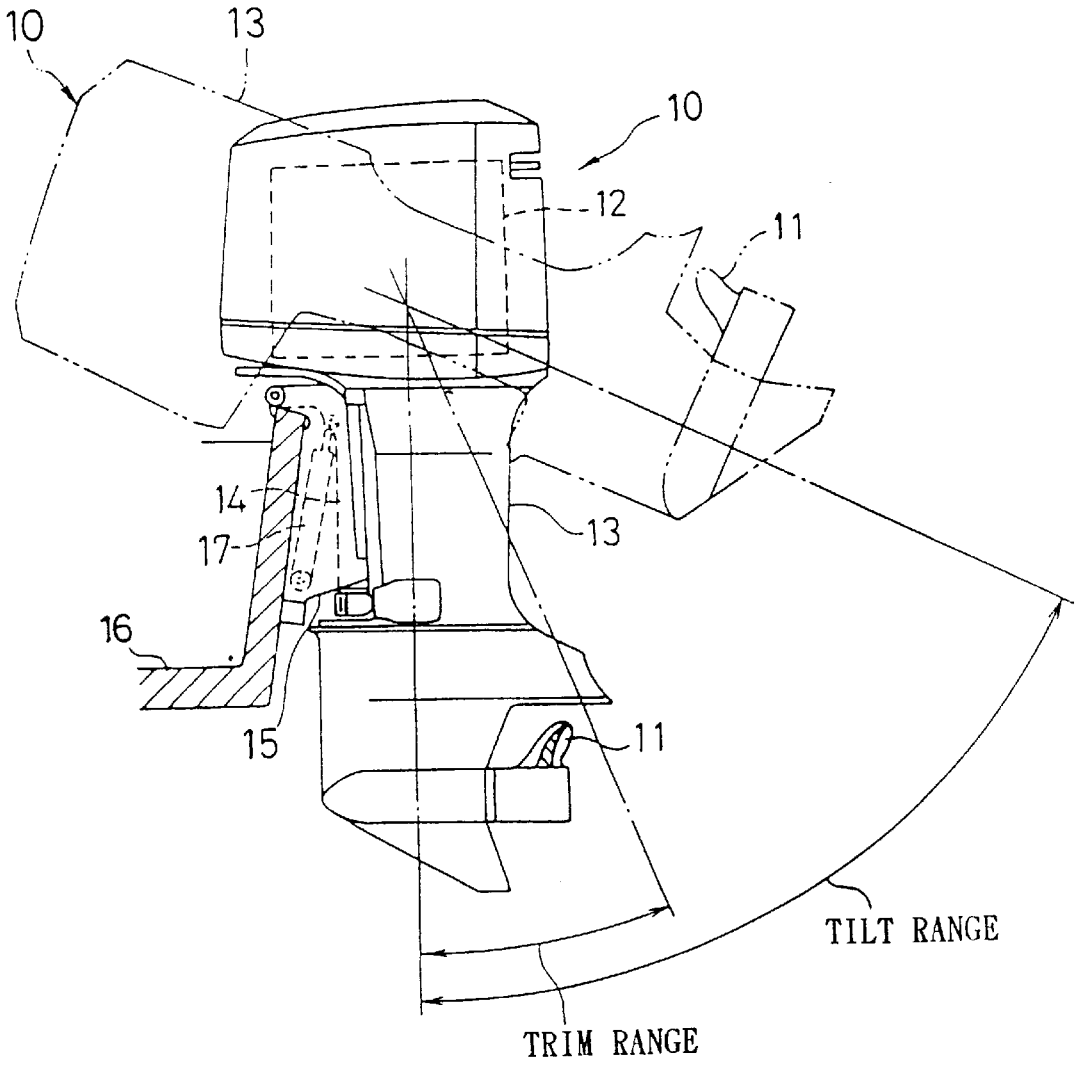
FIG. 1 is a side view of an outboard motor with a first embodiment of a tilt device for a marine propulsion device of the present invention.
Figure 2:
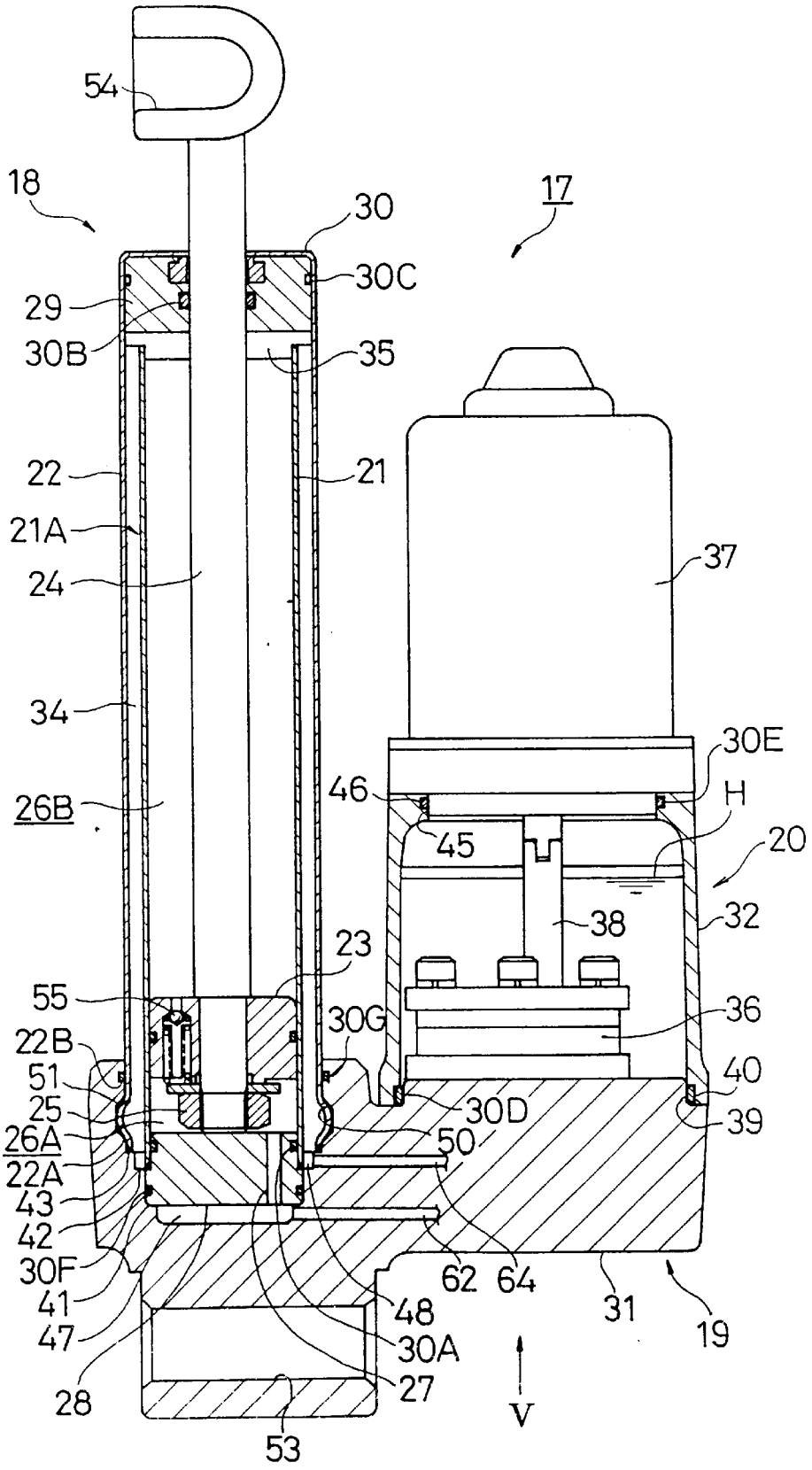
FIG. 2 is a cross-sectional view of the tilt device.
Figure 3:
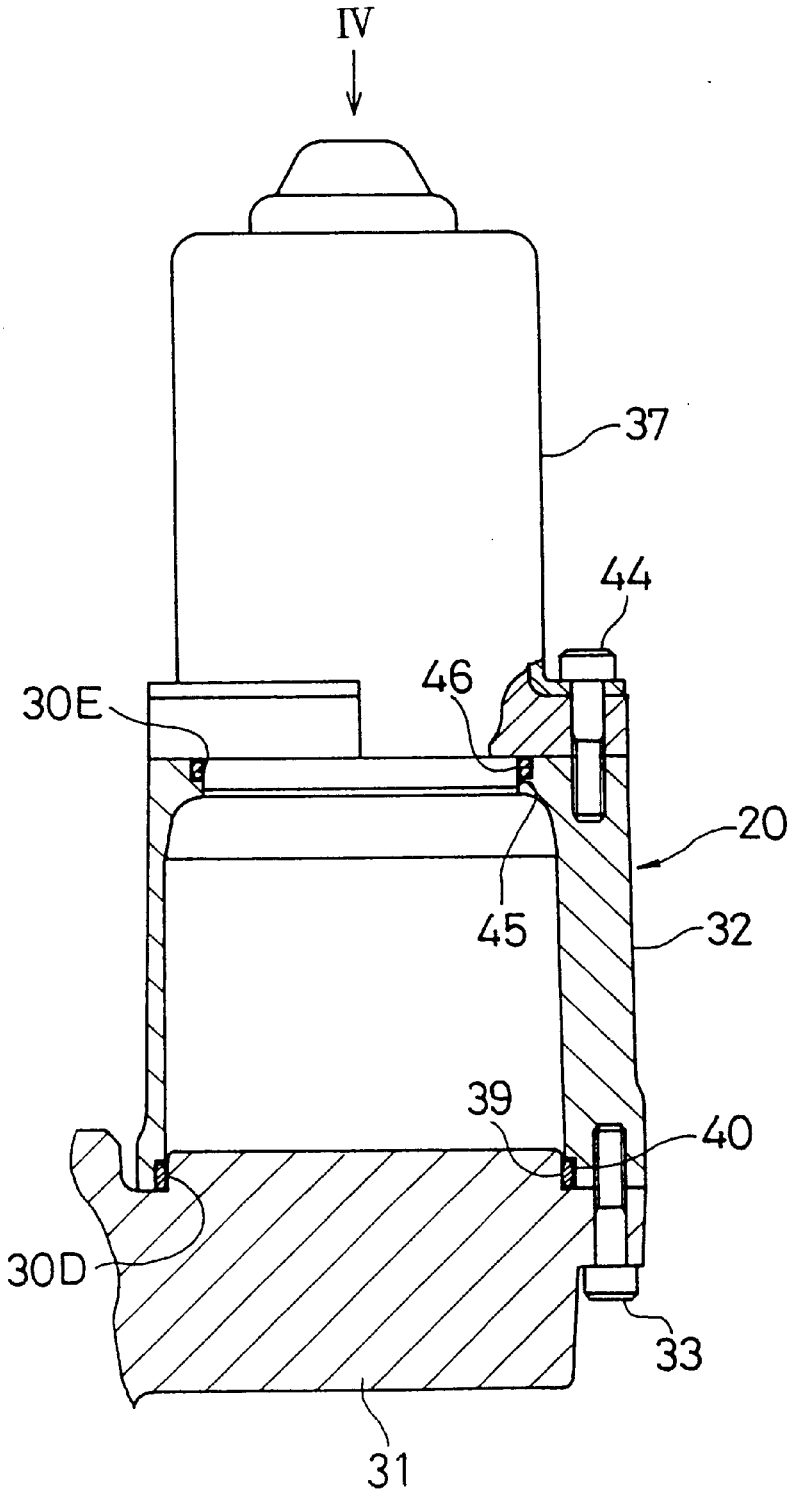
FIG. 3 is a partial cross-sectional view of the tilt device taken on a break line different from that of FIG. 2 (the line III—III of FIG. 5)
Figure 4:
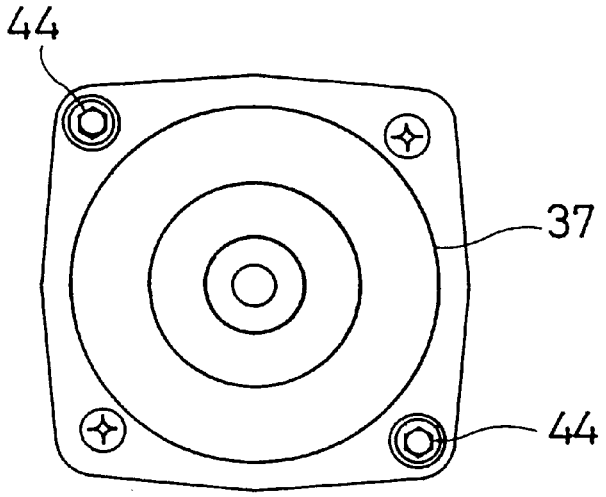
FIG. 4 is an end view viewed from the arrow IV of FIG. 3.
Figure 5:
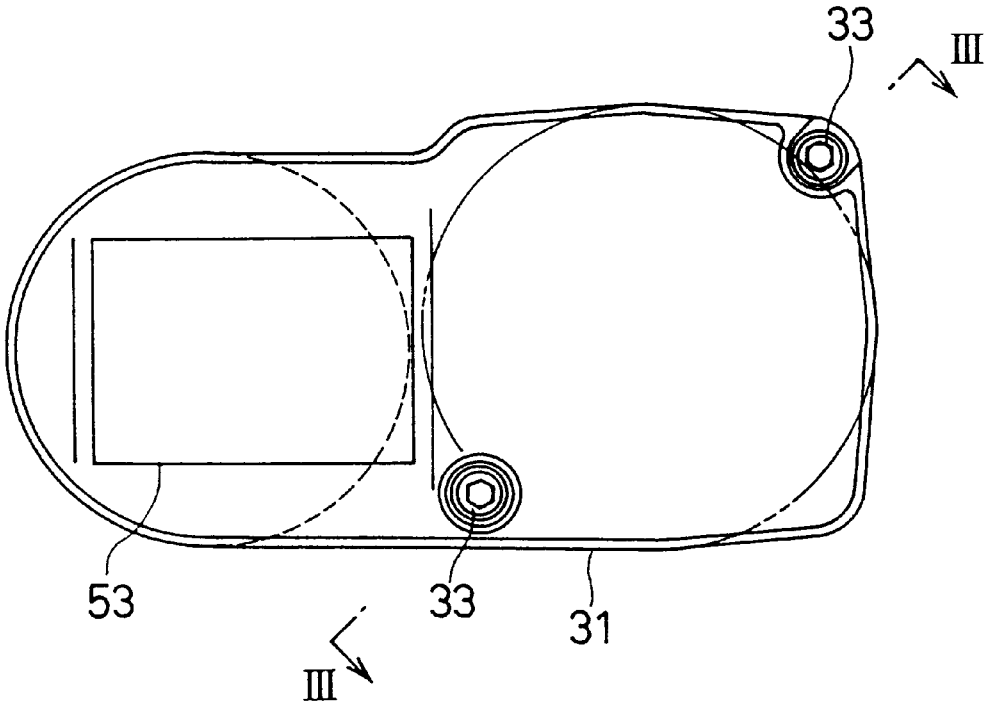
FIG. 5 is an end view viewed from the arrow V of FIG. 2.
Figure 6:
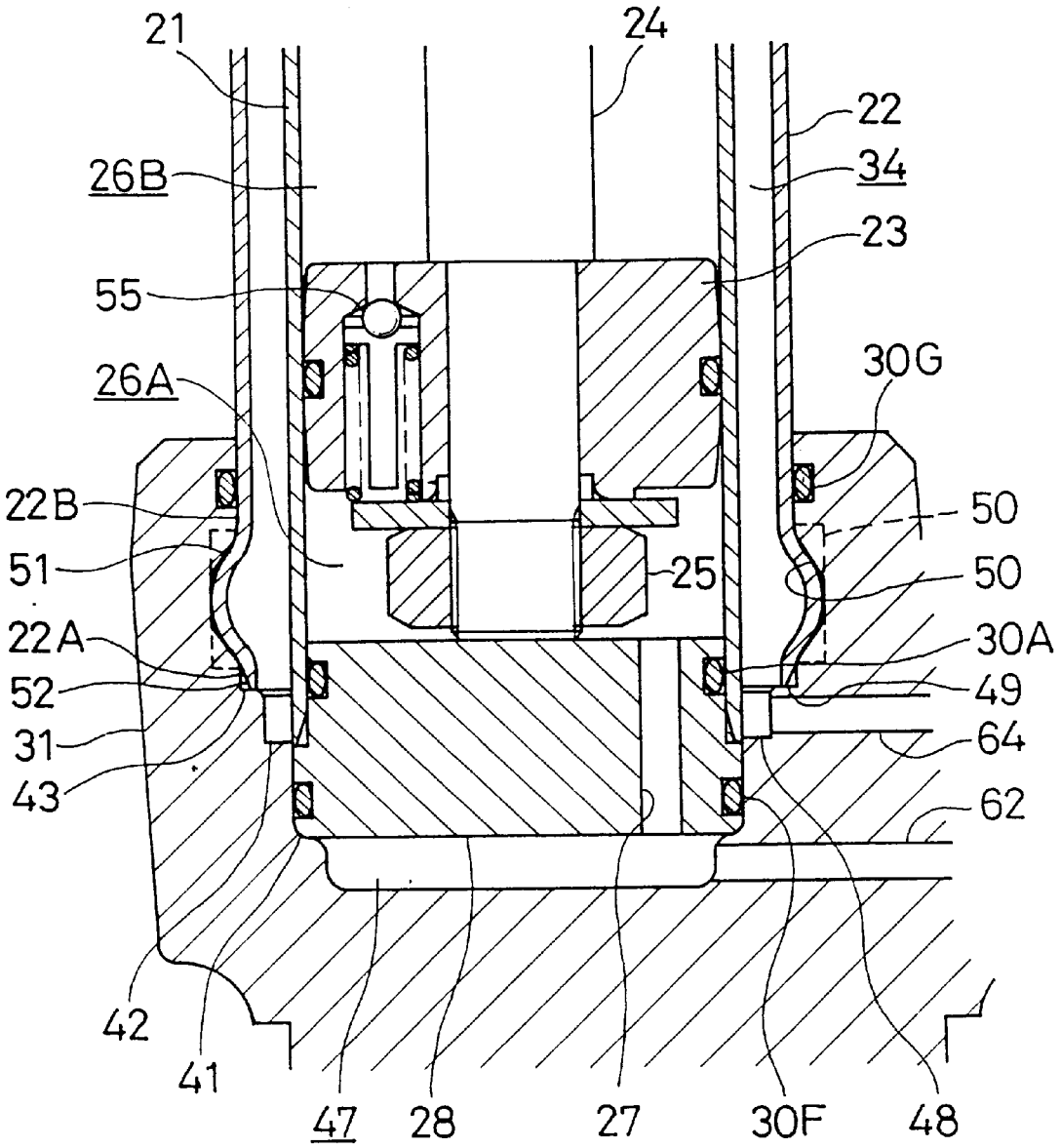
FIG. 6 is an enlarged cross-sectional view of one end portion of the cylinder.
Figure 7:
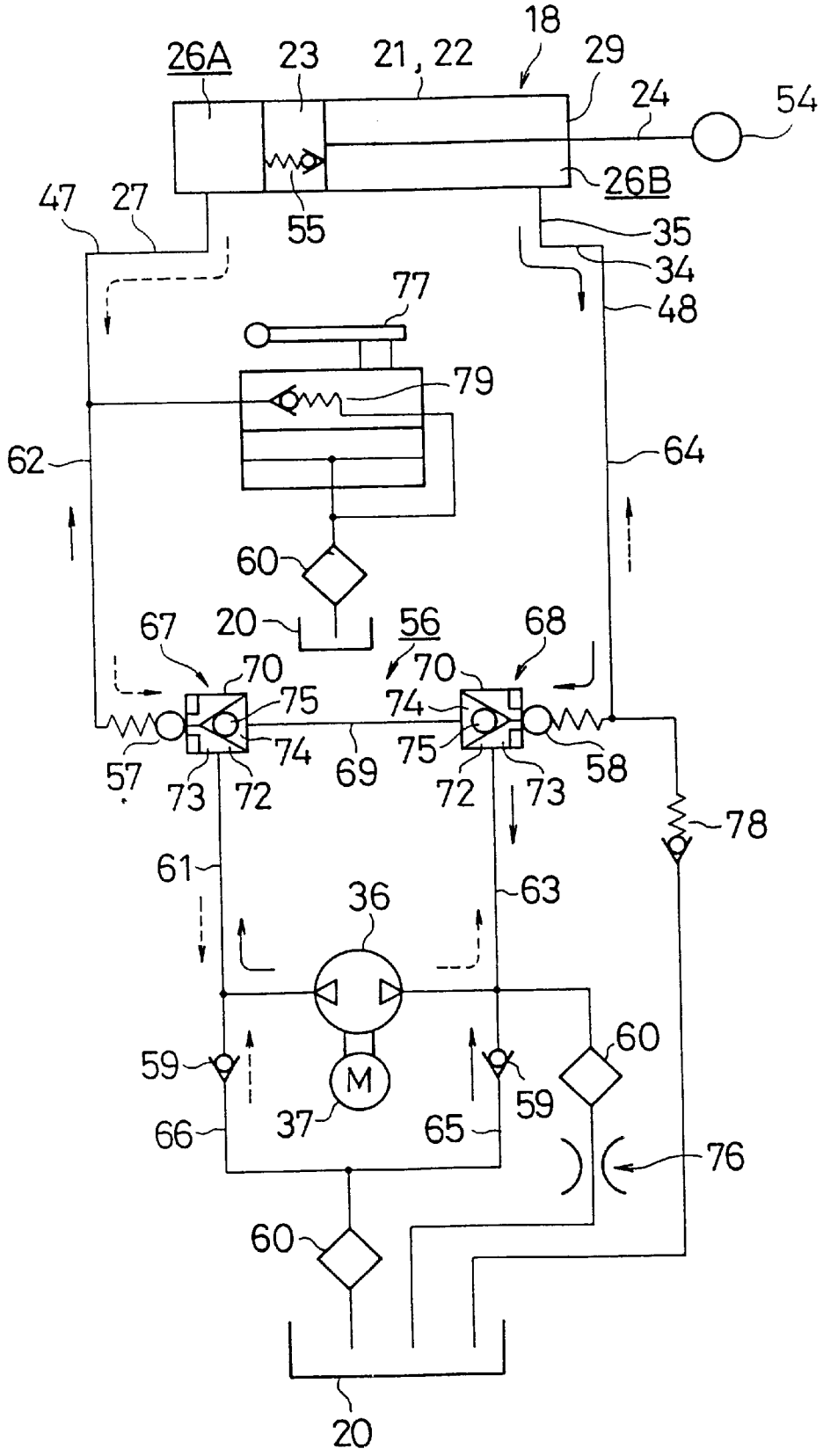
FIG. 7 is a circuit diagram of a hydraulic circuit of the tilt device.

FIG. 1 is a side view of an outboard motor applied with a first embodiment of a tilt device for a marine propulsion device of the present invention. FIG. 2 is a cross-sectional view of the tilt device. FIG. 3 is a partial cross-sectional view of the tilt device taken on a break line different from that of FIG. 2 (the line III—III of FIG. 5). FIG. 4 is an end view viewed from the arrow IV of FIG. 3. FIG. 5 is an end view viewed from the arrow V of FIG. 2. FIG. 6 is an enlarged cross-sectional view of one end portion of the cylinder. FIG. 7 is a circuit diagram of a hydraulic circuit of the tilt device.

As shown in FIG. 1, an outboard motor 10 as the marine propulsion device comprises a propulsion unit 13 comprising a propeller 11 and an engine 12, supported axially by a swivel bracket 14 such that a horizontal axis swinging movement is allowed, with the swivel bracket 14 supported by a clamp bracket 15 such that a vertical axis tilting movement is allowed. Since the clamp bracket 15 grips the hull 16 so as to be fixed to the hull 16, the propulsion unit 13 can swing horizontally and tilt vertically with respect to the hull 16. By the forward or reverse rotation of the propeller 11 of the outboard motor 10 by the engine 12, the hull 16 moves forward or backward.

A tilt device 17 is provided between the swivel bracket 14 and the clamp bracket 15 of the outboard motor 10. The motive power is generated by the telescopic motion of the tilt device 17 and the propulsion unit 13 of the outboard motor 10 so as to allow the tilt operation or the trim operation of the propulsion unit 13 of the outboard motor 10. The trim operation refers to the operation of adjusting the angle of the propulsion unit 13 resisting to the thrust of the propeller 11 during the sailing of the hull 16 so as to change the sailing direction of the hull 16. The tilt operation refers to the operation of tilting the propulsion unit 13 resisting to the self-weight during a stoppage or a grounding of the hull 16 so as to raise the propulsion unit 13 above water.

As shown in FIG. 2, the tilt device 17 comprises a hydraulic cylinder device 18, a pump device 19 and a tank device 20. In the tilt device 17, the hydraulic cylinder device 18 comprises an inner cylinder 21 and an outer cylinder 22 formed of pipe materials, with one end portion of the inner cylinder 21 and the outer cylinder 22 assembled to a cast-molded valve block 31 as later described of the pump device 19, with a tank case 32 of the tank device 20 connected with the valve block 31 with bolts 33 (FIG. 3) as later described.

The inner cylinder 21 and the outer cylinder 22 of the hydraulic cylinder device 18 are made of a drawing-molded pipe steel material, with a piston 23 accommodated slidably in the inner cylinder 21, which is filled with hydraulic fluid. The piston 23 is connected with a piston rod 24 at one end with a nut 25. The inside of the inner cylinder 21 is divided into a rod side space 26B for accommodating the piston rod 24 and a piston side space 26A, not for accommodating the piston rod 24 by the piston 23.

One end portion of the inner cylinder 21 is closed by a lid 28 having a through hole 27, and sealed fluid-tightly with an O ring 30A. A rod guide 29 is fitted on the other end portion of the inner cylinder 21 and the outer cylinder 22, stopped by a caulking portion 30 of the outer cylinder 22 so as to prevent the slip-off. The other end portion of the outer cylinder 22 is sealed fluid-tightly by O rings 30B, 30C provided at the inner periphery and the outer periphery of the rod guide 29, respectively.

A cylinder channel 34 is formed between the inner cylinder 21 and the outer cylinder 22, communicating with the rod side space 26B via a notch portion 35 formed in the rod guide 29. The through hole 27 of the lid 28 communicates with the piston side space 26A.

The pump device 19 comprises a gear pump 36 and a motor 37, with the valve block 31 cast-molded with an aluminum alloy. A first stage portion 41, a second stage portion 42, and a third stage portion 43 are formed with diameters successively enlarged at one end, and the gear pump 36 is fixed at the other end in the valve block 31. The gear pump 36 is interlocked with the motor 37 via a driving shaft 38 rotatably in the forward or backward direction.

The tank case 32, capable of storing a hydraulic fluid (fluid surface H), of the tank device 20 is provided so as to surround the gear pump 36 at the other end side of the valve block 31. The tank case 32 is supported by the valve block 31 at two points by two bolts 33 provided diagonally as shown in FIGS. 3 and 5. An O ring 30D is arranged vertically between a fitting surface 39 of the other end of the valve block 31 and an inner periphery surface 40 of the lower end portion of the tank case 32 in FIG. 2, contacting with the fitting surface 39 and the inner periphery surface 40, such that the tank case 32 is sealed fluid-tightly by the O ring 30D.

The motor 37 of the pump device 19 is supported by the tank case 32 at two points by two bolts 44 arranged diagonally as shown in FIGS. 3 and 4. An O ring 30E is arranged vertically between a fitting surface 45 of the motor 37 and an inner periphery surface 46 of the upper end portion of the tank case 32 in FIG. 2, contacting the fitting surface 45 and the inner periphery surface 46, such that the tank case 32 is sealed fluid-tightly by the O ring 30E.

As shown in FIG. 6, the first stage portion 41 formed at one end of the valve block 31 is formed with substantially the same diameter size as the inner cylinder 21 of the hydraulic cylinder device 18 so as to contact and fit with the closing lid 28 inserted and attached to the inner cylinder 21. In the state where the closing lid 28 is fitted, an fluid storage space 47 is formed between the closing lid 28 and the valve block 31. The fluid storage space 47 communicates with the through hole 27 of the closing lid 28 and it communicates with a second piston side space channel 62 formed in the valve block 31 later described.

A ring-like channel 48 is formed in the second stage portion 42 around the inner cylinder 21 fitted to the valve block 31. The ring-like channel 48 communicate with the cylinder channel 34 of the hydraulic cylinder device 18 and communicates with a second rod side space channel 64 formed in the valve block 31 later described. The ring-like channel 48 and the fluid storage space 47 are sealed fluid-tightly by an O ring 30F provided at the outer periphery of the closing lid 28.

The third stage portion 43 is formed with substantially the same diameter size as the outer cylinder 22 so as to contact the end surface 49 of the outer cylinder 22 and fit with the one end portion of the outer cylinder 22. Furthermore, a ring-groove-like cylinder fixing portion 50, having a diameter larger than that of the outer cylinder 22 and a groove cross-section of a round shape, is formed in the vicinity of the third stage portion 43. In the one end portion of the outer cylinder 22, the end surface 49 contacts the third stage portion 43, with a position slightly away from the end surface 49 toward the upper direction in FIG. 6 enlarged in the diameter by a bulge processing so as to form a protrusion portion 51 having a round shape as the cylinder fixing portion 50. The protrusion portion 51 formed by bulge processing is fitted to the cylinder fixing portion 50 so as to fix the outer cylinder 22 with the valve block 31.

At the time, a linear portion 22A at the end surface 49 side and a liner portion 22B at the side opposite to the end surface 49 are supported by valve block 31 at both sides of the protrusion portion 51 with respect to the axial direction of the outer cylinder 22. Accordingly, backlash of the outer cylinder 22 with respect to the valve block 31 can be prevented so that the outer cylinder 22 can be supported securely by the valve block 31.

An O ring 30G, contacting with the outer periphery of the linear portion 22B of the outer cylinder 22, is provided in the valve block 31 so as to seal the ring-like channel 48 fluid-tightly. Furthermore, a chamfer portion 52 is formed at the outer periphery side of the linear portion 22A of the outer cylinder 22 such that the O ring 30G is not damaged by the end surface 49 of the outer cylinder 22 when the outer cylinder 22 is inserted into the valve block 31.

The hydraulic cylinder device 18 is assembled to the valve block 31 of the pump device 19 according to the below-mentioned processes (1) to (3) (see FIG. 2).

(1) One end portion of the outer cylinder 22 is inserted to the third stage portion 43 and the cylinder fixing portion 50 of the valve block 31. By the bulge processing of the one end portion of the outer cylinder 22, the protrusion portion 51 is formed. By fitting the protrusion portion 51 and the cylinder fixing portion 50 of the valve block 31, the outer cylinder 22 is fixed to the valve block 31. The bulge processing is conducted by arranging an elastic body in the one end portion of the outer cylinder 22 inserted in the valve block 31, accommodating the piston in the outer cylinder 22 and pressing the inside of the outer cylinder 22 by the piston so as to deform the one end portion of the outer cylinder 22 to the round shape of the cylinder fixing portion 50 by the elastic body.

(2) The inner cylinder assembly 21A is inserted in the outer cylinder 22 fixed on the valve block 31. The inner cylinder assembly 21A, which is assembled preliminarily before being inserted in the outer cylinder 22, comprises the inner cylinder 21 accommodating the piston 23 and the piston rod 24 therein, having the closing lid 28 and the rod guide 29 attached at the one end portion and the other end portion of the inner cylinder 21, respectively. When the inner cylinder assembly 21A is inserted in the outer cylinder 22, the closing lid 28 is fitted with the first stage portion 41 of the valve block 31.

(3) Then the caulking portion 30 at the other end portion of the outer cylinder 22 is fixed by caulking to the rod guide 29 of the inner cylinder assembly 21A for fixing the inner cylinder assembly 21A to the outer cylinder 22 so as to finish the assembly of the hydraulic cylinder 18 to the valve block 31.

As shown in FIG. 2, a shaft supporting portion 53 is formed in the valve block 31 of the pump device 19 so that the tilt device 17 is supported axially by the clamp bracket 15 (FIG. 1) via the shaft supporting portion 53. A shaft supporting portion 54 is provided at the tip of the piston rod 24 of the hydraulic cylinder device 18 so that the shaft supporting portion 54 is supported axially by the swivel bracket 14 (FIG. 1). As later described, by the supply or exhaust of hydraulic fluid from the gear pump 36 of the pump device 19 to the piston side space 26A or the rod side space 26B of the hydraulic cylinder device 18, the hydraulic cylinder device 18 moves telescopically, that is, the piston rod 24 projects from the inner cylinder 21 and the outer cylinder 22 (extension of the hydraulic cylinder device 18) so as to tilt-up or trim-up the propulsion unit 13, or the piston rod 24 passes inside the inner cylinder 21 and the outer cylinder 22 (contraction of the hydraulic cylinder device 18) to tilt-down or trim-down the propulsion unit 13.

The numeral 55 in FIG. 2 denotes a buffer valve for exhausting hydraulic fluid in the rod side space 26B into the piston side space 26A for absorbing the collision energy by the fluid resistance of the hydraulic fluid flowing in the buffer valve 55 to alleviate the impact when the propulsion unit 13 collides with an obstacle during the sailing of the hull 16 so that the pressure in the rod side space 26B increases above a predetermined value.

As shown in FIG. 7, the gear pump 36 of the pump device 19 is connected with the piston side space 26A of the hydraulic cylinder device 18 via a first piston side space channel 61, a piston side space check valve 57 of a shuttle valve device 56, the second piston side space channel 62, the fluid storage space 47 and the through hole 27 of the closing lid 28. The gear pump 36 is connected with the rod side space 26B of the hydraulic cylinder device 18 via a first rod side space channel 63, a rod side space check valve 58 of the shuttle valve device 56, a second rod side space channel 64, the ring-like channel 48, the cylinder channel 34 and the notch portion 35 of the rod guide 29.

Furthermore, the gear pump 36 is connected with the tank device 20 via a first tank channel 65, and a second tank channel 66. Tank space side check valves 59 for supplying the hydraulic fluid from the tank device 20 only to the gear pump 36 are provided in the first tank channel 65 and the second tank channel 66. The numeral 60 in FIG. 7 denotes a filter.

The shuttle valve 56 comprises a piston side space shuttle valve portion 67 and a rod side space shuttle valve portion 68, the piston side space shuttle valve portion 67 and the rod side space shuttle valve portion 68 are communicated via a communication path 69. The piston side space shuttle valve portion 67 comprises a spool 72 having a piston side space operation check valve 71 slidably in a shuttle cylinder 70, with the inside of the shuttle valve cylinder 70 divided into a main fluid space 73 and a sub fluid space 74. A piston side space check valve 57 is provided in the main fluid space 73 side.

The rod side space shuttle valve 68 has a spool 72 having a rod side space operation check valve 75 slidably in a shuttle cylinder 70, with the inside of the shuttle valve cylinder 70 divided into a main fluid space 73 and a sub fluid space 74. A rod side space check valve 58 is provided in the main fluid space 73 side. The sub fluid spaces 74 of the piston side space shuttle valve portion 67 and the rod side space shuttle valve portion 68 communicate through the communication path 69.

The spool 72 of the piston side space shuttle valve portion 67 and the spool 72 of the rod side space shuttle valve portion 68 move toward the piston side space check valve 57 and the rod side space check valve 58, respectively by the pressure rise in the sub fluid space 74 so that the piston side space check valve 57 and the rod side space check valve 58 can be opened by the pressure.

When the gear pump 36 rotates in the forward direction, the gear pump 36 guides the hydraulic fluid in the tank space 20 into the main fluid space 73 of the piston side space shuttle valve portion 67 in the shuttle valve device 56 via the first tank channel 65 and the first piston side space channel 61 as shown by the solid arrow in FIG. 7. The hydraulic fluid guided into the main fluid space 73 of the piston side space shuttle valve portion 67 opens the piston side space check valve 57 and also opens the piston side space operation check valve 71, and flows into the sub fluid space 74 of the rod side space shuttle valve portion 68 via the sub fluid space 74 and the communication path 69. Since the rod side space operation check valve 75 is open, the spool 72 of the rod side space shuttle valve portion 68 moves toward the rod side space check valve 58 so as to open the rod side space check valve 58.

According to the opening of the piston side space check valve 57, the hydraulic fluid in the main fluid space 73 of the piston side space shuttle valve portion 67 reaches into the piston side space 26A of the hydraulic cylinder device 18 via the second piston side space channel 62, the fluid storage space 47 and the through hole 27, and the hydraulic fluid in the rod side space 26B is guided to the gear pump 36 via the notch portion 35, the cylinder channel 34, the ring-like channel 48, the second rod side space channel 64, the rod side space check valve 58 (opened state) and the first rod side space channel 63 as shown by the solid arrow in FIG. 7. As a result, the piston 23 moves in the direction such that the piston rod 24 of the hydraulic cylinder device 18 projects from the inner cylinder 21 and the outer cylinder 22 to extend the hydraulic cylinder device 18. Therefore the tilt-up and trim-up operation of the propulsion unit 13 of the outboard motor 10 can be carried out.

When the gear pump 36 rotates in the reverse direction, the gear pump 36 guides hydraulic fluid in the tank device 20 into the main fluid space 73 in the rod side space shuttle valve portion 68 of the shuttle valve device 56 via the second tank channel 66 and the first rod side space channel 63 as shown by the broken arrow in FIG. 7. The hydraulic fluid introduced into the main fluid space 73 of the rod side space shuttle valve portion 68 opens the rod side space check valve 58 as well as opens the rod side space operation check valve 75, and flows into the sub fluid space 74 of the rod side space shuttle valve portion 67 via the sub fluid space 74 and the communication path 69. Since the piston side space operation check valve 71 is open, the spool 72 of the piston side space shuttle valve portion 67 moves toward the piston side space check valve 57 so as to open the piston side space check valve 57.

According to the opening of the rod side space check valve 58, the hydraulic fluid in the main fluid space 73 of the rod side space shuttle valve portion 68 reaches into the rod side space 26B of the hydraulic cylinder device 18 via the second rod side space channel 64, the ring-like channel 48, cylinder channel 34 and the notch portion 35, and the hydraulic fluid in the piston side space 26A is returned to the gear pump 36 via the through hole 27, the fluid storage space 47, the second piston side space channel 62, the piston side space check valve 57 (opened state) and the first piston side space channel 61 as shown by the broken arrow in FIG. 7. As a result, the piston 23 moves in the direction such that the piston rod 24 enters into the inner cylinder 21 and the outer cylinder 22 to contract the hydraulic cylinder device 18. Therefore the tilt-down and trim-down operation of the propulsion unit 13 of the outboard motor 10 can be carried out.

In the hydraulic circuit of the tilt device 17, a down blow orifice 76 is connected to the first rod side space channel 63, a manual valve 77 is connected to the second piston side space channel 62, and a suction check valve 78 is connected to the second rod side space channel 64. The manual valve 77 enables the second piston side space channel 62 to connect to an up blow thermal blow valve 79 in the ordinary non-operation time.

The down blow orifice 76 guides the hydraulic fluid corresponding to the volume of the piston rod 24 entering the inner cylinder 21 into the tank device 20 at the time the hydraulic cylinder device 18 contracts.

The manual valve 77 is for returning the hydraulic fluid in the piston side space 26A of the hydraulic cylinder device 18 to the tank device 20 manually by the operator so as to contract the hydraulic cylinder device 18 manually in combination with the function of the suction check valve 78 later described for allowing the tilt-down of the propulsion unit 13 manually when the tilt device 17 is out of order.

The suction check valve 78 is for introducing hydraulic fluid in the tank device 20 into the rod side space 26B of the hydraulic cylinder device 18 when the manual valve 77 is in operation, contributing to the manual contraction of the hydraulic cylinder device 18.

The up blow thermal blow valve 79 has the up blow function for introducing excessive hydraulic fluid into the tank device 20 when the gear pump 36 still rotates in the forward direction with the hydraulic cylinder device 18 extended even though the piston 23 contacts with the rod guide 29, and a thermal blow function for exhausting the increased hydraulic fluid in to the tank device 20 when the volume of the hydraulic fluid in the piston side space 26A of the hydraulic cylinder device 18 and the second piston side space channel 62 is increased by the temperature change.

According to the tilt device 17 with the above-mentioned configuration, the below-mentioned effects (1) to (7) can be achieved.

(1) Since the valve block 31 of the pump device 19 is cast-molded and the inner cylinder 21 and the outer cylinder 22 of the hydraulic cylinder device 18 are made of a pipe material, the casting mold can be compact, and thus the cost reduction can be achieved.

(2) Since the inner cylinder 21 and the outer cylinder 22 are formed with a pipe material, the inner cylinder 21 and the outer cylinder 22 can be thin, and thus the hydraulic cylinder device 18 and the tilt device 17 can be compact, production time can be reduced since neither the mirror processing of the inside of the inner cylinder 21 and the outer cylinder 22 nor a long boring processing for forming a channel in the cylinders 21, 22 are necessary.

(3) Furthermore, since the outer cylinder 22 is fixed to the cylinder fixing portion 50 of the valve block 31 by the diameter enlarging processing, the hydraulic cylinder device 18 and the pump device 19 can be connected easily and securely to facilitate assembling.

(4) Since the outer cylinder 22 is fixed to the round shaped cylinder fixing portion 50 in the valve block 31 with the diameter enlarging bulge processing, the outer cylinder 22 of the hydraulic cylinder device 18 and the valve block 31 of the pump device 19 can be fixed further securely and easily.

(5) Since a position slightly away from the end face of the outer cylinder 22 is involved with the diameter enlarging processing to form the protrusion portion 51, the linear portions 22A, 22B at both sides of the protrusion portion 51 are supported by the valve block 31, the outer cylinder 22 of the hydraulic cylinder device 18 can be fixed to the valve block 31 of the pump device 19 securely without generation of backlash of the outer cylinder 22.

(6) Since the inner cylinder 21 is fitted to the first stage portion 41 of the valve block 31 and the outer cylinder 22 is fitted to the third stage portion 43, respectively, the hydraulic cylinder device 18 can be fixed to the pump device 19 securely since the ring-like channel 48 communicating with the cylinder channel 34 of the hydraulic cylinder device 18 is formed in the second stage portion 42 of the valve block 31. The channel is assured so that an external piping with a pipe material is not required.

(7) Since the outer cylinder 22 of the hydraulic cylinder device 18 is fixed to the valve block 31 of the pump device 19, the inner cylinder assembly 21A is inserted into the outer cylinder 22, and the caulking portion 30 of the outer cylinder 22 is fixed to the rod guide 29 of the inner cylinder assembly 21A by caulking so as to fix the inner cylinder assembly 21A to the outer cylinder 22, the assembly of the hydraulic cylinder device 18 and the pump device 19 can be carried out easily and securely.

Figure 8:
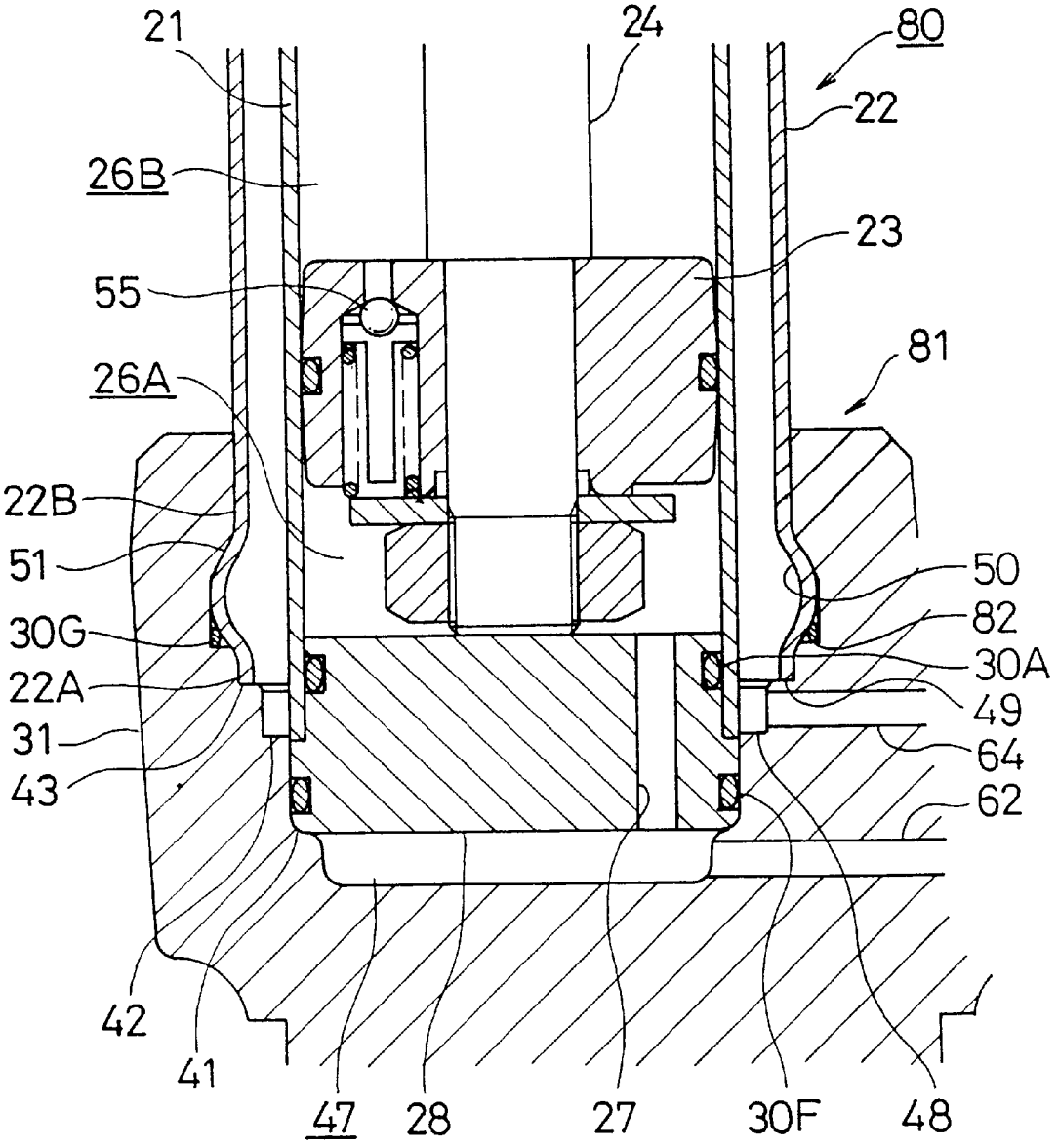
FIG. 8 is a cross-sectional view of an outboard motor applied with a second embodiment of a tilt device for a marine propulsion device of the present invention.

FIG. 8 is a cross-sectional view of an outboard motor using a second embodiment of this invention. In the second embodiment, parts the same as in the above-mentioned first embodiment are identified with the same numerals and further explanation is not provided herein.

An O ring groove 82 for providing an O ring 30G to contact the outer periphery of the outer cylinder 22 is provided at the round shaped protrusion portion 51 in the valve block 31 in a pump device 81 of a tilt device 80 of the second embodiment. Since the protrusion portion 51 has a diameter larger than that of the outer cylinder 22, the below-mentioned effect (8) can be achieved.

(8) Since the O ring groove 82 is formed in the cylinder fixing portion 50 of the valve block 31 and the cylinder fixing portion 50 has a diameter larger than that of the outer cylinder 22, the O ring 30G is not damaged owing to the hitch by the one end portion including the end surface 49 of the outer cylinder 22 even if the outer cylinder 22 is inserted into the cylinder fixing portion 50 after mounting the O ring 30G in the O ring groove 82. Therefore, processing to have the chamfer portion 52 for damage prevention of the O ring 30G as in the first embodiment is not required at the one end portion of the outer cylinder 22.

Although the protrusion portion 51 of the outer cylinder 22 is formed by the bulge processing using an elastic body in the both embodiments, the protrusion portion 51 can be formed by utilizing a liquid pressure or in a method using a diameter enlarging member, except in the elastic body. In the case where liquid pressure is utilized, the protrusion portion 51 can be formed in the outer cylinder 22 by filling a liquid in the outer cylinder 22 and applying a pressure, or can be formed by placing a rubber balloon filled with a liquid in the outer cylinder 22 and applying pressure. In the case where a diameter enlarging member is used, the protrusion portion 51 can be formed by the wedge effect by inserting a plurality of divided rings having an outer periphery fitting with the round shape of the cylinder fixing portion 50, divided in a plurality in the peripheral direction into the outer cylinder 22, and pressing the divided rings with a piston.

Although the cylinder fixing portion 50 formed in the valve block 31 has a round shape in the both embodiments, it can be right circular cylindrical as shown by the broken line in FIG. 6.

Furthermore, the protrusion portion 51 of the outer cylinder 22 can be formed by protrusion processing such as the bulge processing of the part of the outer cylinder 22 including the end surface 49.

As heretofore mentioned, according to the tilt device for a marine propulsion device of the present invention, the reduction of production time, downsizing, and material cost reduction can be achieved along with assembly that is easy and secure. According to the method for assembling the tilt device for a marine propulsion device of the present invention, the device can be assembled easily and securely.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A tilt device for a marine propulsion device comprising a cylinder device with a piston fixed at one end portion of a piston rod provided slidably in a cylinder which is filled with a hydraulic fluid, said cylinder delimited by a pair of end surfaces and having an outer periphery, a tank device capable of storing the hydraulic fluid, and a pump device for supplying and exhausting hydraulic fluid in said tank device for operating said cylinder device telescopically so that the tilt operation of a propulsion unit is carried out by the telescopic motion of said cylinder device, wherein a valve block of said pump device is cast-molded, the cylinder of said cylinder device comprises a pipe material, a cylinder fixing portion formed in said valve block and having a diameter, which said diameter is larger than a diameter of said cylinder, said cylinder fixed at said cylinder fixing portion by diameter enlarging processing.

2. The tilt device for a marine propulsion device according to claim 1, wherein the cylinder fixing portion of said valve block is formed as a groove, with a round shaped groove cross-section, with said cylinder fixed to said cylinder fixing portion by enlarging the diameter with bulge processing.

3. The tilt device for a marine propulsion device according to claim 2, wherein a position slightly away from one of said end surfaces of said cylinder is subjected to a diameter enlarging processing so as to be fixed to the cylinder fixing portion of the valve block.

4. The tilt device for a marine propulsion device according to claim 3, wherein an O ring groove for an O ring contacting with the outer periphery of the cylinder is provided in the cylinder fixing portion of said valve block.

5. The tilt device for a marine propulsion device according to claim 4, wherein said cylinder device comprises an inner cylinder and an outer cylinder having a cylinder channel formed between said cylinders, a first stage portion, a second stage portion, and a third stage portion all formed with diameters successively enlarged in said valve block and said cylinder fixing portion is formed near said third stage portion, said first stage portion is formed with substantially the same diameter as said inner cylinder so as to fit with the inner cylinder, said third stage portion is formed with substantially the same diameter as said outer cylinder so as to fit with the outer cylinder, and a channel formed in said second stage portion, said channel of said second stage portion communicating with the cylinder channel formed between said inner and outer cylinders.

6. The tilt device for a marine propulsion device according to claim 3, wherein said cylinder device comprises an inner cylinder and an outer cylinder having a cylinder channel formed between said cylinders, a first stage portion, a second stage portion, and a third stage portion all formed with diameters successively enlarged in said valve block and said cylinder fixing portion is formed near said third stage portion, said first stage portion is formed with substantially the same diameter as said inner cylinder so as to fit with the inner cylinder, said third stage portion is formed with substantially the same diameter as said outer cylinder so as to fit with the outer cylinder, and a channel formed in said second stage portion, said channel of said second stage portion communicating with the cylinder channel formed between said inner and outer cylinders.

7. The tilt device for a marine propulsion device according to claim 2, wherein an O ring groove for an O ring contacting with the outer periphery of the cylinder is provided in the cylinder fixing portion of said valve block.

8. The tilt device for a marine propulsion device according to claim 7, wherein said cylinder device comprises an inner cylinder and an outer cylinder having a cylinder channel formed between said cylinders, a first stage portion, a second stage portion, and a third stage portion all formed with diameters successively enlarged in said valve block and said cylinder fixing portion is formed near said third stage portion, said first stage portion is formed with substantially the same diameter as said inner cylinder so as to fit with the inner cylinder, said third stage portion is formed with substantially the same diameter as said outer cylinder so as to fit with the outer cylinder, and a channel formed in said second stage portion, said channel of said second stage portion communicating with the cylinder channel formed between said inner and outer cylinders.

9. The tilt device for a marine propulsion device according to claim 2, wherein said cylinder device comprises an inner cylinder and an outer cylinder having a cylinder channel formed between said cylinders, a first stage portion, a second stage portion, and a third stage portion all formed with diameters successively enlarged in said valve block and said cylinder fixing portion is formed near said third stage portion, said first stage portion is formed with substantially the same diameter as said inner cylinder so as to fit with the inner cylinder, said third stage portion is formed with substantially the same diameter as said outer cylinder so as to fit with the outer cylinder, and a channel formed in said second stage portion, said channel of said second stage portion communicating with the cylinder channel formed between said inner and outer cylinders.

10. The tilt device for a marine propulsion device according to claim 1, wherein a position slightly away from one of said end surfaces of said cylinder is subjected to a diameter enlarging processing so as to be fixed to the cylinder fixing portion of the valve block.

11. The tilt device for a marine propulsion device according to claim 10, wherein an O ring groove for an O ring contacting with the outer periphery of the cylinder is provided in the cylinder fixing portion of said valve block.

12. The tilt device for a marine propulsion device according to claim 11, wherein said cylinder device comprises an inner cylinder and an outer cylinder having a cylinder channel formed between said cylinders, a first stage portion, a second stage portion, and a third stage portion all formed with diameters successively enlarged in said valve block and said cylinder fixing portion is formed near said third stage portion, said first stage portion is formed with substantially the same diameter as said inner cylinder so as to fit with the inner cylinder, said third stage portion is formed with substantially the same diameter as said outer cylinder so as to fit with the outer cylinder, and a channel formed in said second stage portion, said channel of said second stage portion communicating with the cylinder channel formed between said inner and outer cylinders.

13. The tilt device for a marine propulsion device according to claim 10, wherein said cylinder device comprises an inner cylinder and an outer cylinder having a cylinder channel formed between said cylinders, a first stage portion, a second stage portion, and a third stage portion all formed with diameters successively enlarged in said valve block and said cylinder fixing portion is formed near said third stage portion, said first stage portion is formed with substantially the same diameter as said inner cylinder so as to fit with the inner cylinder, said third stage portion is formed with substantially the same diameter as said outer cylinder so as to fit with the outer cylinder, and a channel formed in said second stage portion, said channel of said second stage portion communicating with the cylinder channel formed between said inner and outer cylinders.

14. The tilt device for a marine propulsion device according to claim 1, wherein an O ring groove for an O ring contacting with the outer periphery of the cylinder is provided in the cylinder fixing portion of said valve block.

15. The tilt device for a marine propulsion device according to claim 14, wherein said cylinder device comprises an inner cylinder and an outer cylinder having a cylinder channel formed between said cylinders, a first stage portion, a second stage portion, and a third stage portion all formed with diameters successively enlarged in said valve block and said cylinder fixing portion is formed near said third stage portion, said first stage portion is formed with substantially the same diameter as said inner cylinder so as to fit with the inner cylinder, said third stage portion is formed with substantially the same diameter as said outer cylinder so as to fit with the outer cylinder, and a channel formed in said second stage portion, said channel of said second stage portion communicating with the cylinder channel formed between said inner and outer cylinders.

16. The tilt device for a marine propulsion device according to claim 1, wherein said cylinder device comprises an inner cylinder and an outer cylinder having a cylinder channel formed between said cylinders, a first stage portion, a second stage portion, and a third stage portion all formed with diameters successively enlarged in said valve block and said cylinder fixing portion is formed near said third stage portion, said first stage portion is formed with substantially the same diameter as said inner cylinder so as to fit with the inner cylinder, said third stage portion is formed with substantially the same diameter as said outer cylinder so as to fit with the outer cylinder, and a channel formed in said second stage portion, said channel of said second stage portion communicating with the cylinder channel formed between said inner and outer cylinders.

17. An assembling method of a tilt device for a marine propulsion device, where a cylinder device comprises an inner cylinder and an outer cylinder, said inner cylinder having a piston interlocked to a piston rod slidably disposed therein, said inner cylinder having one end portion provided with a closing lid, and an other end portion of said inner cylinder provided with a rod guide, and one end portion of said inner cylinder and said outer cylinder fixed to a valve block of a pump device, said valve block having a cylinder fixing portion formed therein, comprising the steps of inserting said outer cylinder into the cylinder fixing portion of said valve block, diameter-enlarging-processing of one end portion of the outer cylinder for fixation to said cylinder fixing portion, accommodating the piston and the piston rod in said inner cylinder to form an inner cylinder assembly, inserting the inner cylinder assembly into said outer cylinder, and caulk-fixing of the other end portion of said outer cylinder to said rod guide of said inner cylinder assembly so as to assemble said cylinder device to said pump device.

* * * * *